US006374070B2

(12) United States Patent
Itoh

(10) Patent No.: US 6,374,070 B2
(45) **Date of Patent: *Apr. 16, 2002**

(54) ELECTROPHOTOGRAPHIC APPARATUS

(75) Inventor: Isami Itoh, Mishima (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/333,971

(22) Filed: Jun. 16, 1999

(30) Foreign Application Priority Data

Jun. 18, 1998 (JP) ..... 10-171949
Jun. 11, 1999 (JP) ..... 11-165136

(51) Int. Cl.[7] ..... G03G 21/00
(52) U.S. Cl. ..... 399/128; 399/296
(58) Field of Search ..... 399/128, 296, 399/159, 127

(56) References Cited

U.S. PATENT DOCUMENTS 4,641,158 A * 2/1987 Takeuchi ..... 347/130
4,645,330 A * 2/1987 Kohyama et al. ..... 399/128
4,853,736 A * 8/1989 Goto et al. ..... 399/296
5,713,064 A * 1/1998 Kasiske et al. ..... 399/99
5,749,029 A * 5/1998 Umeda ..... 399/128
5,983,041 A * 11/1999 Otaki et al. ..... 399/45

* cited by examiner

*Primary Examiner*—Robert Beatty
(74) *Attorney, Agent, or Firm*—Fitzpatrick, Cella, Harper & Scinto

(57) ABSTRACT

An electrophotographic apparatus includes a decreasing device for decreasing the potential difference between the potential of the toner-adhering portion of the photosensitive body and the potential of the toner-nonadhering portion of the photosensitive body after the development by a developing device and before the transfer by a transferring device. The potential of the toner-nonadhering portion is maintained higher than the potential of the toner-adhering portion regardless of a decrease of the potential difference.

6 Claims, 4 Drawing Sheets

ELECTROPHOTOGRAPHIC APPARATUS

BACKGROUND OF THE INVENTION

1. Field of the Invention

This invention relates to an electrophotographic apparatus such as a copying apparatus or a laser beam printer.

2. Related Background Art

There is a well known image forming apparatus of a type in which a toner image electrostatically formed on the surface of an image bearing body such as a photo-sensitive drum is electrostatically transferred to a transfer material (e.g. paper) brought into close contact therewith and which uses an electrically conductive transferring roller or a corona charger as a transferring member.

In this image forming apparatus, the transferring member is urged against or brought into close vicinity to the image bearing body to thereby form a transferring portion therebetween, and the transfer material is passed through this transferring portion and a transfer bias of a polarity opposite to the polarity of the toner image on the image bearing body is applied to the above-mentioned transferring member to thereby transfer the toner image on the image bearing body onto the transfer material.

Recently, image forming apparatuses, particularly laser beam printers and digital copying apparatuses have been advanced in high resolution and an electrostatic latent image formed on the image bearing body is of a very small size. In an electrophotographic apparatus advanced in high resolution (particularly in which the electrostatic image is 600 dpi or greater), to form such an electrostatic latent image, there has been adopted in the image bearing body the technique of thinning the thickness of a photosensitive layer having a charge creating layer and a charge transporting layer from conventional 25 to 30 $\mu$m to 10 to 20 $\mu$m.

FIG. 2B of the accompanying drawings shows the potential distribution on the image bearing body when the thickness of the photosensitive layer is thinned to 15 $\mu$m. What is shown in FIG. 2A of the accompanying drawings is a conventional one in which the thickness of the photosensitive layer is 30 $\mu$m. Comparing the two with each other, in the photosensitive layer of FIG. 2B of which the thickness is 15 $\mu$m, the potential in a light portion $M_D$ to which light was applied and dark portions $M_L$ to which light was not applied, is flat and the electrostatic latent image is sharp. It is also seen that in the edge portions E of the electrostatic latent image, the potential does not gently attenuate but sharply attenuates.

FIG. 4 of the accompanying drawings shows the relation between the thickness of the charge transporting layer and the image property (the reproducibility of the electrostatic latent image). It is seen from FIG. 4 that the image property becomes good from a point at which the thickness of the layer is 15 $\mu$m or less.

The potential distribution as shown in FIG. 2B, i.e., an electrostatic latent image which is sharp and of which the edge portions E are upright (hereinafter simply referred to as the "sharp electrostatic latent image"), is very effective for forming a clear image when a toner is made to adhere to the electrostatic latent image on the image bearing body to thereby develop (visualize) it as a toner image.

In the case of the sharp electrostatic latent image, however, there has been the problem that during transfer, the toner on the image bearing body is liable to be scattered and transferred to a transfer material.

That is, when a toner image is to be transferred from a conventional image bearing body in which the thickness of the photosensitive layer is great, the electric field in the edge portions of the electrostatic latent image attenuates gently and therefore, between a toner-adhering portion and a toner-non-adhering portion, it is difficult for the transfer electric field by transfer bias to be disturbed, whereas in an image bearing body wherein the thickness of the photosensitive layer is made small, a change in the potential of the edge portions of the electrostatic latent image is sudden and therefore, in the transfer electric field, the electric field toward the transfer material is liable to be disturbed. From this disturbance of the transfer electric field, there arises the problem that the toner during transfer is liable to scatter from the toner-adhering portion to the toner-non-adhering portion. This is because as shown by a graph indicated by a dotted line in FIG. 5B of the accompanying drawings, there is a great peak in the course of the potential distribution in the transfer direction between the photosensitive body and the transfer paper in the edge portion of the latent image.

Also, a toner manufactured by the polymerizing method has recently been used. This toner is substantially spherical in its shape and has the characteristic that the transfer efficiency thereof is high. Such a characteristic is very effective for eliminating a cleaner in the image forming apparatus. That is, the transfer efficiency is high and the toner remaining on the surface of the image bearing body after transfer (untransferred toner) is small in quantity and therefore, for example, the collection of the toner by a developing device or the like is possible without providing a cleaning device for exclusive use.

However, this toner has such an excellent characteristic, but when this toner is used for the sharp electrostatic latent image as previously described, there is the problem that depending on the use environment such as temperature and humidity or the kind (e.g. thickness and quality) of the transfer material used, the scattering of the toner when the toner image on the image bearing body is transferred to the transfer material is further increased

SUMMARY OF THE INVENTION

It is an object of the present invention to provide an electrophotographic apparatus in which the thickness of the charge transporting layer of a photosensitive body is 15 $\mu$m or less and which forms a sharp electrostatic image and which is suited for an image of high resolution of which the resolution of the electrostatic image is 600 dpi or greater.

It is another object of the present invention to provide an electrophotographic apparatus which forms a sharp electrostatic image and also prevents the scattering of a toner during transfer.

DESCRIPTION OF THE PREFERRED EMBODIMENTS

Some embodiments of the present invention will hereinafter be described with reference to the drawings.

<Embodiment> 1

Figure 1:
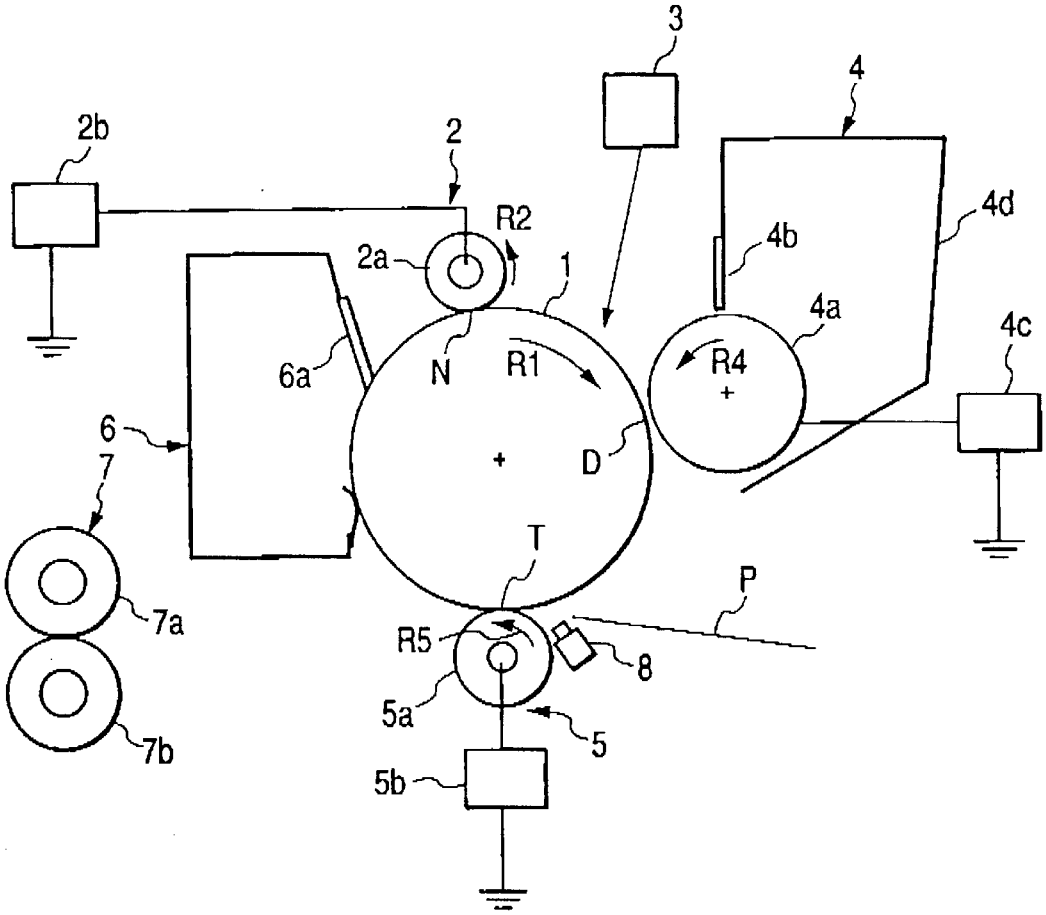
FIG. 1 is a longitudinal cross-sectional view schematically showing the construction of an image forming apparatus according to Embodiment 1 of the present invention.

FIG. 1 shows an embodiment of an image forming apparatus according to the present invention. FIG. 1 is a longitudinal cross-sectional view schematically showing the construction of a laser beam printer.

The laser beam printer (hereinafter referred to as the "image forming apparatus"), as shown in FIG. 1, is provided with a drum type electrophotographic photosensitive body 1 (hereinafter referred to as the "photosensitive drum"), as an image bearing body. The photosensitive drum 1 is rotatively driven in the direction of arrow R1 by driving means (not shown). Around the photosensitive drum 1, a charging device 2, exposure means 3, a developing device 4, a transferring device 5, and a cleaning device 6 are disposed along the direction of rotation thereof in the named order. Also, a fixing device 7 is disposed downstream (on the left side as viewed in FIG. 1) of the transferring device 6 with respect to the direction of conveyance of a transfer material P and further, potential attenuating means 8 which is a feature of the present invention is disposed upstream of the transferring device 5 with respect to the direction of rotation of the photosensitive drum 1.

A description will hereinafter be made in detail in succession from the photosensitive drum 1.

The photosensitive drum 1 is comprised of a photosensitive layer having a charge creating layer and a charge transporting layer provided on the outer peripheral surface of a cylindrical drum base body.

As the drum base material, use can be made of a drum base body itself having electrical conductivity, for example, aluminum, an aluminum alloy, copper, zinc, stainless steel, chromium, titanium, nickel, magnesium, indium, gold, platinum, silver, iron or the like. Besides these, use can be made of a drum base body itself formed of a dielectric base material having no electrical conductivity. For example, plastic or the like, having the surface thereof coated with a material having electrical conductivity such as aluminum, indium oxide, tin oxide or gold as by evaporation to thereby provide an electrically conductive layer so as to have electrical conductivity as a whole, or electrically conductive fine particles mixed with plastic or paper, or the like.

An under coating layer having the charge pouring blocking function and the adhesively securing function may be provided between the above-described drum base body and the photosensitive layer. The under coating layer can be formed by casein, polyvinyl alcohol, nitrocellulose, ethylene acrylic acid copolymer, polyvinyl butylal, phenol resin, polyamide, polyurethane, gelatin or the like. The thickness of the under coating layer is 0.1 to 10 $\mu$m, and preferably 0.3 to 3 $\mu$m.

For example, as a charge creating material forming the charge creating layer, use can be made of selenium-tellurium, a pyrylium dye, a chiopyrylium dye, a phthalocyanine pigment, an anthoanthrone pigment, a dibenzpyreneguinon pigment, a pyrauethoron pigment, a trisazo pigment, a disazo pigment, an azo pigment, an indigo pigment, a quinaklydon pigment, a cyanin pigment or the like.

As a charge transporting material forming the charge transporting layer, use can be made of a high molecular compound having a heterocycle such as poly-N-vinylcarbazole or polystilanthracene or a condensation polynuclear aromatic compound, a heterocyclic compound such as pyrazoline, imidazole, oxazole, oxadiazole, triazole or carbazole, a triaryl alkane derivative such as triphenylmethane, a triarylamine derivative such as tophenylamine, or a low molecular compound such as a phenylene diamine derivative, an N-phenyl carbazole derivative, a stilbene derivative or a hydrazone derivatiive.

A binder polymer is used as the charge creating material or the charge transporting material as required. As an example of the binder polymer, mention may be made of a polymer and a copolymer of vinyl compounds such as styrene, vinyl acetate, vinyl chloride, acrylic acid ester, methacrylic acid ester, vinylidene fluoride and trifluoroethylene, polyvinyl alcohol, polyvinyl acetal, polycarbonate, polyester, polysulfone, polyphenylene oxide, polyurethane, cellulose resin, phenol resin, melamine resin, silicon resin, epoxy resin or the like.

As the photosensitive layer, besides the above-mentioned compounds, an additive can be used to improve the mechanical characteristic thereof and improve the durability thereof. As such an additive, use is made of a oxidation preventing agent, an ultraviolet ray absorbing agent, a stabilizing agent, a bridging agent, a lubricating agent, an electrically conductive controlling agent or the like.

The charging device 2 has a charging roller 2*a* disposed in contact with the photosensitive drum 1, and a charging bias applying power source 2*b* for applying a charging bias thereto. A charging nip portion N is formed between the charging roller 2*a* and the photosensitive drum 1. The charging device 2 can also use a corona charger which is of a non contact type, besides the charging roller 2*a*. The charging device 2 is rotated in the direction of arrow R2 with the rotation of the photosensitive drum 1 in the direction of arrow R1, and uniformly charges the surface of the photosensitive drum 1 to a predetermined polarity and predetermined potential by the charging bias applied by the charging bias applying power source 2*b*.

For example, as the exposure means 3, use can be made of a laser scanner. The exposure means 3 irradiates the surface of the photosensitive drum 1 after charged in conformity with image information to thereby remove any charges on the irradiated portion and form an electrostatic latent image.

The developing device 4 has a developing container 4*d* containing a developer therein, a developing sleeve 4*a* disposed in the opening portion of the developing container 4*d*, a developing blade 4*b* for regulating the layer thickness of the developer carried on and conveyed by the surface of the developing sleeve 4*a*, and a developing bias applying power source 4*c* for applying a developing bias to the developing sleeve 4*a*. The developing sleeve 4*a* is disposed in opposed relationship with the surface of the photosensitive drum 1 with a minute gap therebetween, and forms a developing nip portion D between itself and the photosensitive drum 1. The toner used in the present embodiment will be described later in detail The transferring device 5 has a transferring roller 5*a* disposed in contact with the surface of the photosensitive drum 1 and forming a transfer nip portion T, and a transferring bias applying power source 5*b* for applying a transferring bias to the transferring roller 5*a*. The transferring roller 5*a* is rotated in the direction of arrow R5 with the rotation of the photosensitive drum 1 in the direction of arrow R1. A transfer material P contained in a paper supply cassette (not shown) and conveyed by feeding and conveying means (not shown) is held and conveyed by the above-mentioned transfer nip portion T. At this time, the transferring bias is applied to the transferring roller 5*a* by the transferring bias applying power source 5*b*. Thereby, the toner image on the photosensitive drum 1 is transferred onto the transfer material P.

After the transfer of the toner image, the transfer material P is heated and pressed by the fixing device 7 having a fixing roller 7*a* and a pressing roller 7*b* and has the toner image fixed on its surface, whereafter it is discharged out of the image forming apparatus body.

On the other hand, the photosensitive drum 1 after the transfer of the toner image, any toner that has not been transferred to the transfer material P but remaining on its surface (untransferred toner), removed by the cleaning blade 6*a* of the cleaning device 6 and is used for the next image formation.

The toner used in the present invention will now be described in detail.

Regarding the toner, it is preferable that in the observation of the cross-sectional surfaces of toner particles using a transmission electronic microscope (TEM), a wax component is not melted with binding resin and will be dispersed in the fashion of islands substantially in a spherical shape and/or a spindle shape. The wax component is then dispersed as described above and is contained in the toner, whereby the deterioration of the toner and the contamination or the like of the image forming apparatus can be prevented and therefore, good chargeability is maintained and it becomes possible to form toner images excellent in dot reproduction for a long period. Also, during heating, the wax component acts efficiently and therefore, the low temperature fixing property and the offset resistance during fixing are made satisfactory.

In the present embodiment, as a specific method of observing the cross-sectional surfaces of toner particles, toner particles are sufficiently dispersed in epoxy resin of a room temperature hardening property, whereafter they are hardened in an atmosphere of a temperature 40° C. for two days, and the hardened matter thus obtained is dyed with trisuchenium tetroxide, and also triosmium tetroxide, whereafter a laminate sample is cut out by the use of a microtome provided with diamond teeth, and the cross-sectional shape of the toner particles is observed by the use of a transmission electronic microscope. In the present invention, some difference in crystallinity between the wax component used and the resin forming the crust is utilized to provide contrast between the materials and therefore, it is preferable to use the triruthenium tetroxide dyeing method.

In the toner particles used in the present embodiment, it has been observed that the wax component is contained in the crust resin.

As the wax component in the present embodiment, use is made of one having a maximum heat absorbing peak in an area of 40 to 130° C. during temperature rise in the DSC curve measured by a differential scanning calorimeter. It has the maximum heat absorbing peak in the above-mentioned temperature area 40 to 130° C. (×40 to 130), whereby it greatly contributes to low temperature fixing and yet effectively manifests a parting property. When the maximum heat absorbing peak is less than 40° C., the self-cohesive force of the wax component becomes weak and as the result, the high temperature resisting offset property is aggravated and the gross becomes too high.

On the other hand, if the maximum heat absorbing peak exceeds 130° C., the fixing temperature becomes high and it becomes difficult to moderately smooth the surface of the fixed image and therefore, particularly when a color toner is used, it is not preferable from the point of a reduction in color mixing property. Further, when granulation and polymerization are effected in a water medium and a toner is to be directly obtained by the polymerizing method, if the maximum heat absorbing peak temperature is high, there arises the problem that a wax component is deposited during granulation, and this is not preferable.

The measurement of the maximum heat absorbing peak temperature of the wax component is effected in accordance with "ASTM standard D 3418-8". For the measurement, for example, DSC-7 produced by Perkin-Elmer Corp. is used. The melting points of indium and zinc are used for the temperature correction of the detecting portion of the apparatus, and the heat of melting of indium is used for the correction of the quantity of heat. A pan made of aluminum is used as a sample to be measured, and an empty pan is set for reference, and it is raised and dropped once in temperature and its pre-history is taken, whereafter measurement is effected at a temperature rise speed of 10° C./min.

As the wax component, utilization can specifically be made of paraffin wax, polyolefin wax, fischer tropisch wax, amide wax, higher fatty acid, ester wax, a derivative thereof, or a graft/block compound thereof or the like.

Regarding the toner used in the present embodiment, a shape factor SF-1 (a coefficient indicating the degree of roundness of a toner particle) measured by an image analyzing apparatus is 100 to 160 and a shape factor SF-2 (a coefficient indicating the degree of unevenness of a toner particle) is 100 to 140. It is more preferable that the value of the shape factor SF-1 be 100 to 140 and the value of the shape factor SF-2 be 100 to 120. Also, the above-mentioned conditions are satisfied and the value of (SF-2)/(SF-1) is made 1.0 or less, whereby not only the characteristics of the toner but also the matching with the image analyzing apparatus becomes very good.

The shape factors SF-1 and SF-2 used in the present invention are values obtained by sampling at random 100 toner images enlarged to a magnification 500 times by the use of FE-SEM (S-800) produced by Hitachi, Ltd., introducing the image information thereof into an image analyzing apparatus (Luzex 3) produced by Nicolet Japan Corporation through an interface and analyzing it, and calculating it by the following expressions:

$$SF\text{-}1=\{(MXLNG)^2/\mathrm{AREA}\}\times(\pi/4)\times 100$$

$$SF\text{-}2=\{(PERI)^2/\mathrm{AREA}\}\times(1/4\pi)\times 100$$

where

AREA: toner projected area

MXLNG: absolute maximum length of a toner particle

PERI: peripheral length of the toner particle

The spherical shape factor SF-1 of the toner, as described above, indicates the degree of roundness of a toner particle, and is 100 when the toner particle is of a completely spherical shape, and the numerical value thereof increases as the shape gradually changes from the spherical shape to an indefinite shape. On the other hand, SF-2 indicates,the degree of unevenness of the toner particle, and the numerical value thereof becomes greater as the unevenness of the surface of the toner becomes remarkable.

If the shape factor SF-1 exceeds 160, the shape of the toner becomes an indefinite shape and therefore, the charging amount distribution of the toner becomes broad and the surface of the toner becomes liable to be tritulated in the developing container 4*d* of the developing device 4, thus causing a reduction in image density and the fogging of images.

To enhance the transfer efficiency of the toner image, it is preferable that the shape factor SF-2 of the toner particle be 100 to 140 and the value of (SF-2)/(SF-1) be 1.0 or less. If the shape factor SF-2 of the toner particle is greater than 140 and the value of (SF-2)/(SF-1) exceeds 1.0, the surface of the toner particle is not smooth and the toner particle has a lot of unevenness, and the transfer efficiency from the photosensitive drum 1 to the transfer material P tends to be reduced.

Further, in order to faithfully develop minute latent image dots to obtain a higher quality of image, it is preferable that the weight average particle diameter of the toner particles be 10 μm or less (preferably 4 to 8 μm) and the fluctuation coefficient A (to be described) in number distribution be 35% or less. If the weight average particle diameter is less than 4 μm, many untransferred toner particles will remain on the photosensitive drum 1 from a reduction in transfer efficiency and further, this is liable to cause the irregularity of images based on fog and bad transfer, and such toner is not preferable as the toner used in the present embodiment. On the other hand, if the weight average particle diameter of the toner particles exceeds 10 μm, the fusion to the surface of the photosensitive drum 1 is liable to occur. This tendency will further strengthen if the fluctuation coefficient in the number distribution of the toner particles exceeds 35%.

The particle size distribution of toner particles can be measured by various methods. In the present invention, the measurement was effected by the use of a Calltar counter. For example, a Calltar counter TA-II type (produced by Calltar Inc.) or Calltar multisizer (produced by Calltar Inc.) is used as a measuring apparatus, and an interface (Nihon Kagaku Kiki Inc.) and a personal computer outputting a number distribution and a volume distribution are connected thereto, and as electrolyte, first class sodium chloride is used to adjust 1% Nacl water solution. For example, ISOTONII (produced by Calltar Inc.) can be used. As the measuring method, 0.1 to 5 ml of interfacial active agent (preferably alkyl benzene sulfonic acid salt) is added as a dispersing agent to 100 to 150 ml of the electrolytic water solution, and 2 to 20 mg of measurement sample is further added. The electrolyte in which the sample is suspended is subjected to a dispersing process for about 1 to 3 minutes by an ultrasonic dispersing device. For example, an aperture of 100 μm is used as an aperture and with a number as a reference, the particle size distribution of particles of 2 to 40 μm is measured by the aforementioned Calltar counter TA-II type, and then the shape factors of the present embodiment are found.

The fluctuation coefficient A in the number distribution of the toner particles is calculated from the following expression:

$$\text{fluctuation coefficient } A \times (S/D1) \times 100,$$

where S indicates the standard deviation in the number distribution of the toner particles, and D1 indicates the number average particle diameter (μm) of the toner particles.

Further, it is preferable to use toner particles of which the surfaces are covered with an extraneous additive as the toner particles used in the present embodiment, and to impart a desired charging amount to the toner.

In that sense, the covering amount of the extraneous additive on the surface of the toner may be 5 to 99%, and preferably 10 to 99%.

The covering rate of the extraneous additive on the surface of the toner is found by sampling 100 toner images at random by the use of FE-SEM (S-800) produced by Hitachi, Ltd., and the image information thereof is introduced into the image analyzing apparatus (Luzex 3) produced by Nicolet Japan Corporation through an interface. The image information obtained is binarized and found by being divided into the area SG of the extraneous additive portion and the area (including the area of the extraneous additive portion) ST of the toner particle portion, and is calculated from the following expression:

$$\text{the covering rate of extraneous additive } (\%) = (SG/ST) \times 100$$

As the extraneous additive used in the present embodiment, it is preferable that it have a particle diameter of 1/10 or less of the weight average of the toner particles, from the viewpoint of the durability when it is added to the toner. The particle diameter of this additive means the average particle diameter found by the observation of the surfaces of the toner particles in an electronic microscope.

For example, the extraneous additive, use is made, of a metal oxide (such as aluminum oxide, titanium oxide, strontium titanate, cerium oxide, magnesium oxide, chromium oxide, tin oxide or zinc oxide), a nitride (such as silicon nitride), a carbide (such as silicon carbide), metallic salt (such as calcium sulfate, barium sulfate or calcium carbonate), fatty acid metallic salt (such as zinc stearate or calcium stearate), carbon black, silica or the like.

Regarding these extraneous additives, 0.01 to 10 parts by weight, and preferably 0.05 to 5 parts by weight are used relative to 100 parts by weight of toner particles. These extraneous additives may be used singly or plurally. They may preferably be subjected to hydrophobic processing.

When the amount of addition of the extraneous additive is less than 0.01 part by weight, the fluidity of a one-component developer is aggravated and the efficiency of transfer and development is reduced, and the density irregularity of images and the so-called scattering, i.e., the scattering of the toner to the periphery of the image portion, occur. On the other hand, when the amount of the extraneous additive exceeds 10 parts by weight, too much extraneous additive adheres to the photosensitive drum 1 and the developing roller 4*a* to thereby aggravate the charging property to the toner or disturb the image.

A detailed description of the present invention will further be made with specific numerical values mentioned.

The layer construction of the photosensitive drum 1 used in the present embodiment is, in succession from the drum base body side, a charge creating layer and a charger transporting layer. The thicknesses of the respective layers are 2 μm for the charge creating layer and 15 μm for the charge transporting layer.

The image resolution (recording resolution) of the image forming apparatus used in the present embodiment is 1200 dpi, and the charging and exposing conditions of the photosensitive drum 1 were such that a semiconductor laser having an optical spot diameter of 25 μm was used as the exposure means 3 and the charged potential of the nonimage portion (dark portion) $M_D$ which is the nonexposed portion of the surface of the photosensitive drum 1 was −500V and the solid potential of the image portion (light portion) $M_L$ which is the exposed portion of the surface of the photosensitive drum 1 was −100V. Also, as the exposure means 3, use can be made of an LED through a Celfoc lens, or other optical systems such as an EL (electroluminescence) element or a plasma light-emitting element. Here, the non-image portion $M_D$ is a toner nonadhering portion in an area which comes into contact with the transfer material at the transfer position, and of course, the toner-nonadhering portion changes in conformity with image information.

The developing conditions were such that the minute gap between the photosensitive drum 1 and the developing sleeve 4*a* was 500 μm and a rectangular wave having an AC component of 2.0 kHz and 2.0 kVpp was used as the developing bias and the DC component was set to −350V.

The developing device 4 used a two-component developer comprising a toner and a carrier as a developer, and the toner used was a nonmagnetic negatively chargeable toner having the weight average diameter of 5 μm, and the carrier used was an ordinary magnetic carrier having a weight average diameter of 20 to 100 μm. The developing system is a reversal developing system using a toner of the same charging polarity as the charging polarity of the charging bias.

A feature of the present embodiment is that provision is made of potential attenuating means 8 for attenuating the charged potential of the surface of the photosensitive drum 1. For example, as the potential attenuating means 8, use can be made, of an LED as light applying means, and it is disposed so as to be opposed to the surface of the photosensitive drum 1 downstream of the developing nip portion D and upstream of the transfer nip portion T along the direction of rotation (the direction of arrow R1) of the photosensitive drum 1. More particularly, it is disposed so as to irradiate the surface of the photosensitive drum 1 just ahead of the transfer nip portion T. By the light application from this LED, the quantity of light is adjusted so as to drop the charged potential of the nonimage portion (toner-nonadhering portion) $M_D$ from −500V to −250V which is 50% thereof. As the potential attenuating means 8, use can be made of an LCD, a halogen lamp, a fluorescent lamp or the like, instead of the above-mentioned LED.

Figure 2A:
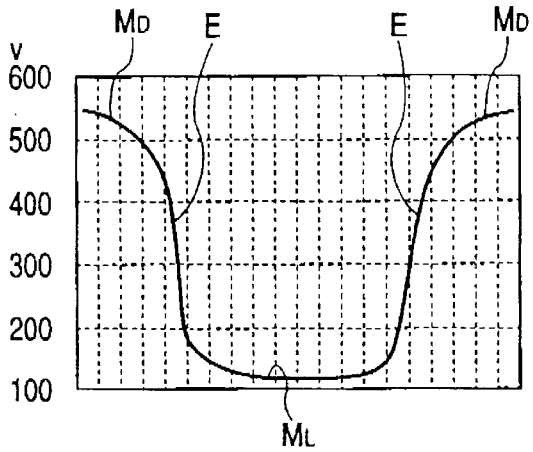
FIG. 2A shows the potential distribution of a conventional electrostatic latent image.
Figure 2B:
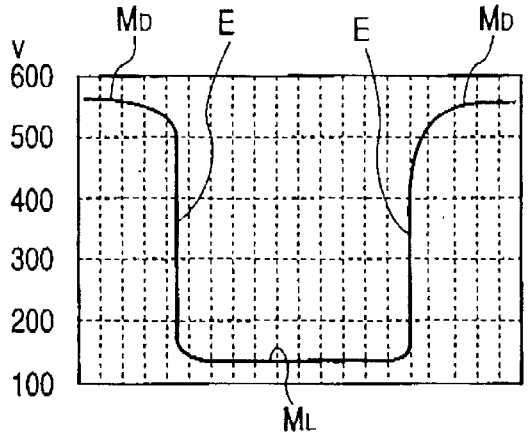
FIG. 2B shows the potential distribution of the electrostatic latent image of the present invention.

The potential distribution of the latent image formed on the photosensitive drum 1 is a sharp one in which the edge portion is erect as shown in FIG. 2B due to the effect of the charge transporting layer (15 μm or less) made into thin film, and as shown in Table 1 below, the reproducibility of the electrostatic latent image is good as compared with that on a conventional thick photosensitive layer. Also, the toner image formed by development is firmly held on the photosensitive drum 1 and goes toward the transfer nip portion T.

By the charge transporting layer being made as thin as 15 μm or less, the electrostatic image becomes suited for high resolution (600 dpi or greater).

Figure 2C:
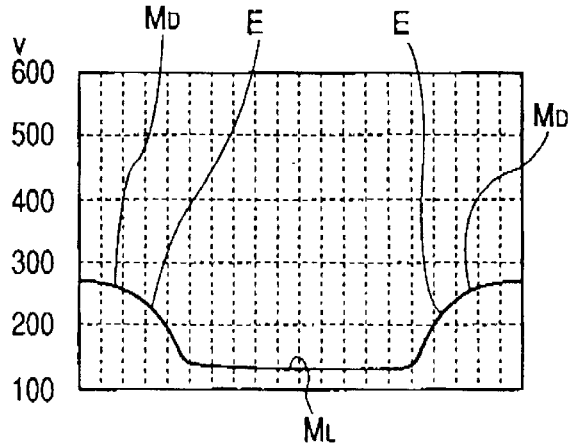
FIG. 2C shows the potential distribution of an electrostatic latent image after the charging potential has been attenuated in the present invention.

In the present embodiment, light is applied from the potential attenuating means 8 disposed just ahead of the transfer nip portion T to thereby attenuate the charged potential of the surface of the photosensitive drum. Thereby, as regards the latent image potential of FIG. 2B, in the transfer nip portion T, the potential of the nonimage portion $M_D$ is attenuated as shown in FIG. 2C, and the edge portion E of the electrostatic latent image becomes smooth.

As described above, when the potential difference between the image portion (toner-adhering portion) $M_L$ and the nonimage portion (toner-nonadhering portion) $M_D$ becomes small, the transfer electric field applied to the toner image during the transfer in the transfer nip portion T becomes uniform as compared with the state of FIG. 2B. As a result, as shown in Table 1, there is obtained a good transferred image free of the scattering of the toner.

TABLE 1

| photosensitive body | on photosensitive body | exposure before transfer | |
|---|---|---|---|
| | | absent | present |
| conventional photosensitive body | Δ | x | x |
| thin-film photosensitive body | ○ | Δ | ○ |

In Table 1 above, the photosensitive drum having a thick photosensitive layer is represented as the "conventional photosensitive body" and the photosensitive drum of the present embodiment having a thin charge transporting layer is represented as the "thin-film photosensitive body". Further, "on photosensitive body" shows the state of the toner image developed on the surface of the photosensitive drum, and "exposure before transfer absent, present" shows the states of the toner images on the respective transfer materials P. Evaluation was done at three stages, i.e., good (○), somewhat bad (Δ) and bad (×). According to this, regarding the conventional photosensitive body, the toner image on the photosensitive body is somewhat bad, and the toner images on the transfer materials are bad for both of the absence and presence of the exposure before transfer. In contrast, regarding the thin-film photosensitive body, the toner image on the photosensitive body was good, and the toner image on the transfer material was somewhat bad when the exposure before transfer was absent and was good when the exposure before transfer was present. That is, in the present embodiment, both of the toner image on the photosensitive body and the toner image on the transfer material when "pre-exposure" was present were good.

Figure 5A:
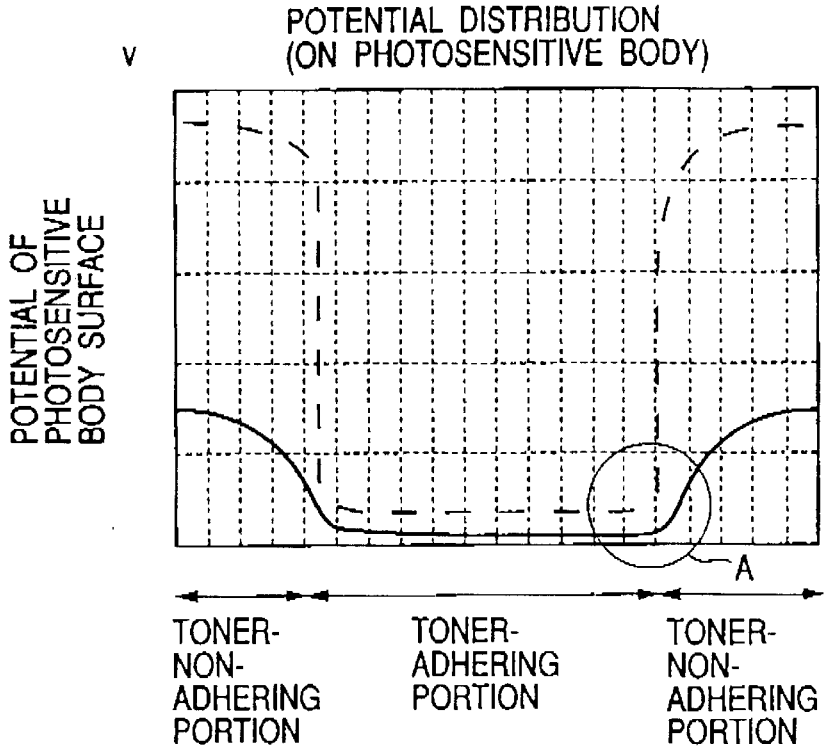
FIGS. 5A and 5B are illustrations of the potential distribution of a photosensitive body.

FIG. 5A shows the potential distributions of the latent image before exposure (dotted line) and after exposure (solid line) by the potential attenuating means 8. Comparing the changes in the potential before exposure and after exposure with each other, the change in the potential in the area A of the edge portion becomes small in the potential distribution after exposure. Seeing the potential distribution in the direction of transfer between the photosensitive body and the transfer material in the area A shown in FIG. 5B, it has a great peak before exposure (dotted line) and during transfer, the toner affected by this scatters, but in the potential distribution after exposure (solid line), this peak has disappeared and during transfer, there is no fluctuation of the electric field and therefore, the scattering of the toner does not occur.

Figure 5B:
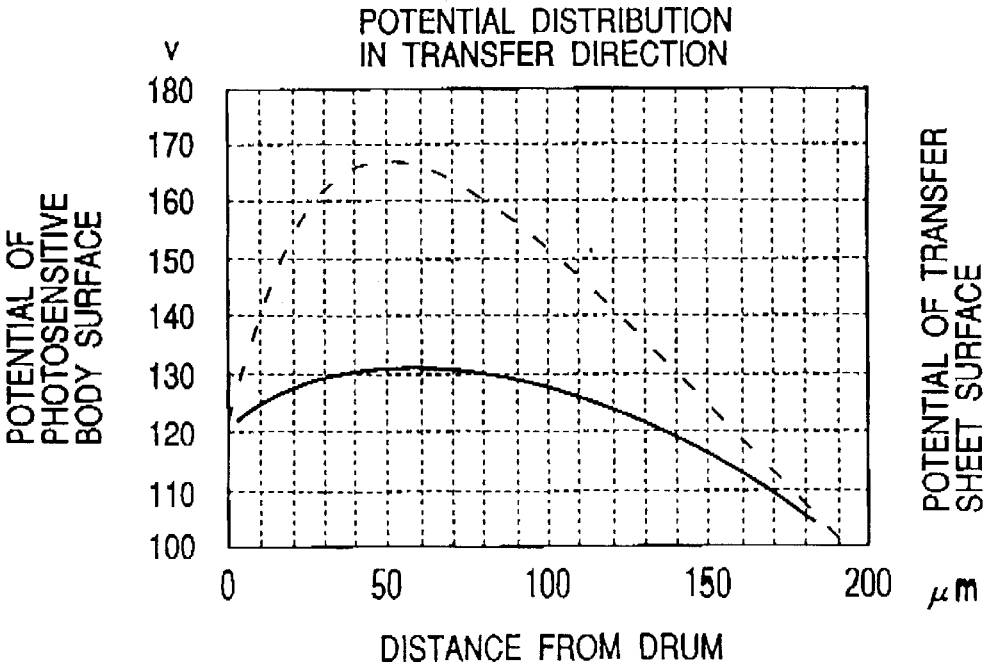

By the potential of the nonimage portion being attenuated after development and before transfer by the potential attenuating means 8, the electric field from the photosensitive body in the latent image edge portion in the area A of FIG. 5A toward the transfer material changes from the state indicated by dotted line in FIG. 5B before the potential of the non-image portion is attenuated to the state indicated by solid line in FIG. 5B in which the potential of the non-image portion has been attenuated. By eliminating this great peak of the electric filed from the photosensitive body toward the transfer material, the disturbance of the electric field in the transfer nip portion can be eliminated. Also, the potential of the surface of the photosensitive body in the nonimage portion is attenuated to 50% of the charged potential and therefore, the surface potential of the non-image portion and the surface potential of the exposed portion do not become equal to each other, and by the effect of the remaining electric field by the latent image, the toner image is prevented from being destroyed by the repulsion of the charges of the toner.

When as described above, the potential difference between the image portion and the nonimage portion has become small, the transfer electric field applied to the toner image in the transfer nip portion N becomes uniform as compared with the state of FIG. 2B. As the result, as shown in Table 1, a good transferred image free of the scatter of the toner was obtained by effecting the exposure before transfer.

When the potential of the surface of the photosensitive body attenuated by the potential attenuating means 8 is smaller than 20% of the charged potential of the photosensitive body before attenuated by the potential attenuating means 8, the electric field formed by the latent image on the photosensitive body disappears and the toner image becomes liable to be destroyed by the repulsion of its own charges Accordingly, it is preferable that the potential of the photosensitive body after attenuated is 20% or more of the potential of the photosensitive body before attenuated.

Also, it is preferable for the prevention of the scattering of the toner during transfer that the potential of the photosensitive body after attenuated is 60% or less of the potential of the photosensitive body before attenuated.

The potential attenuating means 8 may not only attenuate the potential of the nonimage portion, but also may more or less attenuate the potential of the image portion. That is, even if the potential of the image portion is attenuated, the difference between the potential of the image portion and the potential of the nonimage portion can be decreased.

<Embodiment 2>

Figure 3:
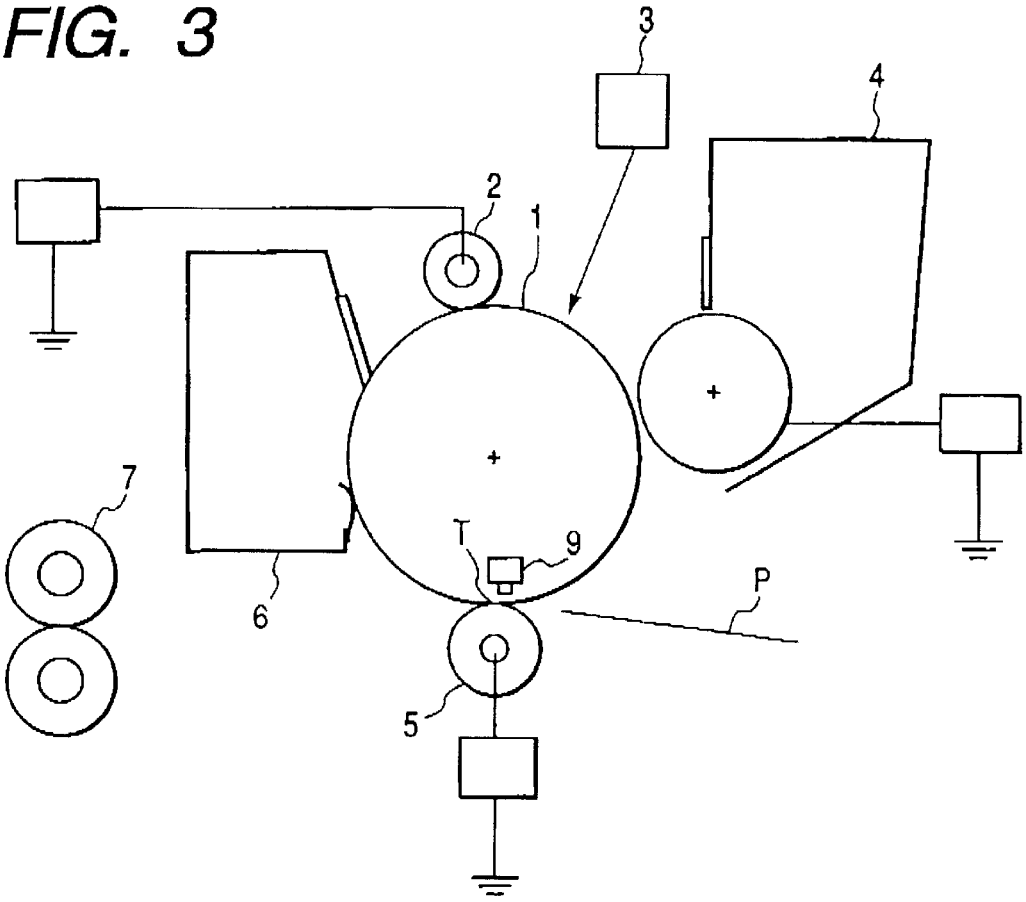
FIG. 3 is a longitudinal cross-sectional view schematically showing the construction of an image forming apparatus according to Embodiment 2 of the present invention.
Figure 4:
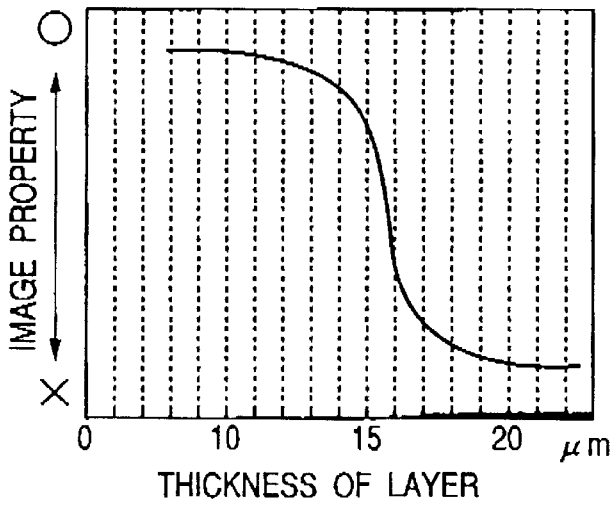
FIG. 4 shows the relation between a photosensitive layer and an image property.

FIG. 3 schematically shows the construction of an image forming apparatus according to Embodiment 2 of the present invention. In this embodiment, an LED (light applying means as potential attenuating means 9 for attenuating the charged potential of the surface of the photosensitive drum 1 is disposed just ahead of the transfer nip T inside the photosensitive drum 1. The quantity of emitted light of the potential attenuating means 9, as in the above-described Embodiment 1, was a quantity of light for dropping the charged potential of the nonimage portion $M_D$ of the photosensitive drum 1 from −500 V to 50% thereof, i.e., −250V.

The other conditions are also similar to those in Embodiment 1.

The photosensitive drum 1 in the present embodiment has a transparent base body formed of a light transmitting material as a drum base body. The charge creating layer and the charge transporting layer are described in Embodiment 1.

In the present embodiment, the drum base body of the photosensitive drum 1 is transparent and therefore, the light from the charge attenuating means 9 disposed inside the photosensitive drum 1 is transmitted through the drum base body, and it becomes possible to create a photocarrier in the charge creating layer and attenuates the potential of the surface of the photosensitive drum 1.

As a result, as in Embodiment 1, it becomes possible to attenuate the potential of the nonimage portion of the latent image immediately before transfer, and it has become possible to make a potential difference between the image portion $M_L$ and the nonimage portion $M_D$ small, and obtain a good transferred image free of the scattering of the toner.

What is claimed is:

1. An electrophotographic apparatus comprising:

a photosensitive body having a photosensitive layer provided with a charge transporting layer and a charge generating layer, a thickness of said charge transporting layer being 15 $\mu$m or less;

an electrostatic image forming means for forming an electrostatic image on said photosensitive body, said electrostatic image forming means being provided with a charging means for charging said photosensitive body, and an exposure means for image-exposing said photosensitive body charged by said charging means;

developing means for developing said electrostatic image with a toner of the same charging polarity as a charging polarity of said charging means to thereby form a toner image;

transferring means for electrostatically transferring said toner image to a transfer material; and decreasing means for decreasing the potential difference between a potential of a toner-adhering portion of said photosensitive body and a potential of a toner-nonadhering portion of said photosensitive body after a development by said developing means and before a transfer by said transferring means;

wherein said decreasing means attenuates the potential of the toner-adhering portion of said photosensitive body by 20% to 60%.

2. An electrophotographic apparatus according to claim 1, wherein the shape factor SF-1 of said toner is 100 to 160, and the shape factor SF-2 of said toner is 100 to 140.

3. An electrophotographic apparatus according to claim 1, wherein said photosensitive body is provided with a transparent base body supporting said photosensitive layer, and said decreasing means is provided inside said transparent base body and irradiates light to said photosensitive body through said transparent base body.

4. An electrophotographic apparatus comprising:

a photosensitive body having a photosensitive layer provided with a charge transporting layer and a charge generating layer, a thickness of said charge transporting layer being 15 $\mu$m or less;

an electrostatic image forming means for forming an electrostatic image on said photosensitive body, said electrostatic image forming means being provided with a charging means for charging said photosensitive body, and an exposure means for image-exposing said photosensitive body charged by said charging means, a resolution of said electrostatic image being 600 dpi or greater;

developing means for developing said electrostatic image with a toner of the same charging polarity as a charging polarity of said charging means to thereby form a toner image;

transferring means for electrostatically transferring said toner image to a transfer material; and decreasing means for decreasing the potential difference between a potential of a toner-adhering portion of said photosensitive body and a potential of a toner-nonadhering portion of said photosensitive body after a development by said developing means and before a transfer by said transferring means, the potential of the toner-nonadhering portion being maintained higher than the potential of the toner-adhering portion after a decrease of the potential difference caused by said decreasing means, and the potential of the toner-nonadhering portion of said photosensitive body being attenuated by 20% to 60% by the decrease of the potential difference caused by said decreasing means.

5. An electrophotographic apparatus according to claim 4, wherein the shape factor SF-1 of said toner is 100 to 160, and the shape factor SF-2 of said toner is 100 to 140.

6. An electrophotographic apparatus according to claim 1 or 4, wherein said decreasing means is light irradiating means for irradiating said photosensitive body with light.

* * * * *

UNITED STATES PATENT AND TRADEMARK OFFICE

CERTIFICATE OF CORRECTION

PATENT NO. : 6,374,070 B2
DATED : April 16, 2002
INVENTOR(S) : Isami Itoh

It is certified that error appears in the above-identified patent and that said Letters Patent is hereby corrected as shown below:

Column 2,
Line 37, "increased" should read -- increased. --.

Column 3,
Line 54, "butylal," should read -- butyral, --; and
Line 56, "under coating" should read -- undercoating --.

Column 4,
Line 33, "non contact" should read -- noncontact --.

Column 5,
Line 62, "the" (second occurrence) should read -- a --.

Column 6,
Line 57, "indicates,the" should read -- indicates, the --

Column 8,
Line 18, "the" should read -- as the --.

Column 11,
Line 29, "(light" should read -- light --.

Signed and Sealed this

Eleventh Day of June, 2002

*Attest:*

*Attesting Officer*

JAMES E. ROGAN
*Director of the United States Patent and Trademark Office*